US007916885B2

(12) United States Patent
Nielson

(10) Patent No.: US 7,916,885 B2
(45) Date of Patent: Mar. 29, 2011

(54) COMPONENT FOR A HEARING AID AND A HEARING AID

(75) Inventor: Dennis Brian Nielson, Helsinge (DK)

(73) Assignee: WIDEX A/S, Lynge (DK)

( * ) Notice: Subject to any disclaimer, the term of this patent is extended or adjusted under 35 U.S.C. 154(b) by 1216 days.

(21) Appl. No.: 11/529,240

(22) Filed: Sep. 29, 2006

(65) Prior Publication Data

US 2007/0019834 A1 Jan. 25, 2007

Related U.S. Application Data

(63) Continuation-in-part of application No. PCT/DK2004/000222, filed on Mar. 31, 2004.

(51) Int. Cl.
*H04R 25/00* (2006.01)

(52) U.S. Cl. ..... 381/328; 381/322; 381/323

(58) Field of Classification Search ..... 381/312, 381/313, 314, 322, 323, 324, 328; 181/129, 181/130, 135

See application file for complete search history.

(56) References Cited

U.S. PATENT DOCUMENTS

| | | | | |
|---|---|---|---|---|
| 4,598,177 | A | 7/1986 | McGroarty et al. | |
| 4,961,230 | A * | 10/1990 | Rising | 381/323 |
| 5,201,008 | A | 4/1993 | Arndt et al. | |
| 5,206,098 | A | 4/1993 | Cho et al. | |
| 6,409,042 | B1 | 6/2002 | Hirano et al. | |
| 6,430,296 | B1 | 8/2002 | Olsen | |
| 7,039,209 | B2 * | 5/2006 | Schmitt | 381/322 |

FOREIGN PATENT DOCUMENTS

WO 86/06919 A1 11/1986

* cited by examiner

*Primary Examiner* — Huyen D Le
(74) *Attorney, Agent, or Firm* — Sughrue Mion, PLLC

(57) ABSTRACT

A hearing aid (1) comprising a lid (31), an electronics module (4), and a microphone adapter (15), wherein the electronics module and the microphone adapter provides a groove (30) for sliding engagement with a pivot of the lid, the groove extending partially over the electronics module and partially over the adapter between a position where the lid is closed and a position where the lid is partially open.

9 Claims, 6 Drawing Sheets

COMPONENT FOR A HEARING AID AND A HEARING AID

RELATED APPLICATIONS

The present application is a continuation-in-part of application No. PCT/DK2004/000222, filed on Mar. 31, 2004, in Denmark and published as WO 2005/096669 A1.

BACKGROUND OF THE INVENTION

1. Field of the Invention

The present invention relates to hearing aids. The invention, more specifically, relates to an assembly for an In-The-Ear (ITE) hearing aid.

2. The Prior Art

ITE hearings aids have traditionally been constructed by making a shell, which anatomically duplicates the relevant part of the user's ear canal. A receiver is placed in the shell, and the open end of the shell is closed with a faceplate subassembly, connected to the receiver by leads. The faceplate subassembly incorporates a microphone, electronics, a battery compartment and a hinged lid.

WO-A-98/47319 shows a modular In-The-Ear hearing aid wherein an electronics module provides a hinge for a lid. A microphone is integrated into the electronics module. The lid has an opening to allow sound passage to the microphone.

U.S. Pat. No. 5,201,008 shows a modular ITE hearing aid. A battery compartment, a microphone and a volume control are arranged side by side on the top face.

WO-A-01/87013 shows a microphone assembly for an ITE hearing aid, wherein a microphone assembly comprises assembly portions that are snapped together, and a printed electric circuit board.

Hearing aids have been developed to very small sizes, however at the expense of complicated designs and complications in service. The smallest designs feature electronic modules with integrated electrically conductive strips with exposed ends, available for the soldering of leads to other components such as the microphone, the electronic circuit board, the receiver, a programming button etc. Designing and manufacturing such an electronic module is complicated because of the heterogeneous structure and because of the many interfacing requirements. Some designs have involved soldering leads to pads at several sides of the modules, some have required soldering of some leads, then arranging structural fittings and then soldering other leads. Modification, e.g. to accommodate a different type of microphone has required a complete redesign. Attempts to modularize the design have been associated with more bulky structures.

SUMMARY OF THE INVENTION

The invention, in a first aspect, provides a component for a hearing aid comprising an electronics module, and a microphone adapter, wherein the electronics module and the microphone adapter provide a groove for sliding engagement of the pivot of a lid, the groove extending over part of the electronics module and over part of the adapter, between a position where the lid is closed and a position where the lid is partially open.

This provides a modular unit that can be miniaturized more than modular designs of the prior art. The complicated structure and electrical connections are substantially arranged in a general unit that interfaces with a microphone adapter. The microphone adapter has a comparatively simple design. Tailoring of hearing aids to different microphones therefore only requires tailoring of a rather simple adapter unit. The microphone adapter doubles to provide an extension of the groove for the sliding of the pivot for the lid. Therefore miniaturization of the general unit will not be constrained by the size of the lid. The lid can be sized with an extending hinge portion, allowing the lid to free an ample opening for easy access to the battery, and allowing for a lid locking structure.

The locking structure preferably comprises means for sliding the lid between a locked position and a position where the lid may pivot, in order to provide easy manipulation. Further advantageous features appear from the dependent claims.

The invention, in a second aspect, provides a hearing aid comprising a lid, an electronics module, and a microphone adapter, wherein the electronics module and the microphone adapter provide a groove for sliding engagement of the pivot of a lid, the groove extending over part of the electronics module and over part of the adapter, between a position where the lid is closed and a position where the lid is partially open.

Still other features of the present invention will become apparent to those skilled in the art from the following description wherein the invention will be explained in greater detail.

BRIEF DESCRIPTION OF THE DRAWINGS

The invention will now be described in more detail in conjunction with several embodiments and the accompanying drawings, in which.

DETAILED DESCRIPTION OF THE INVENTION

Figure 1:
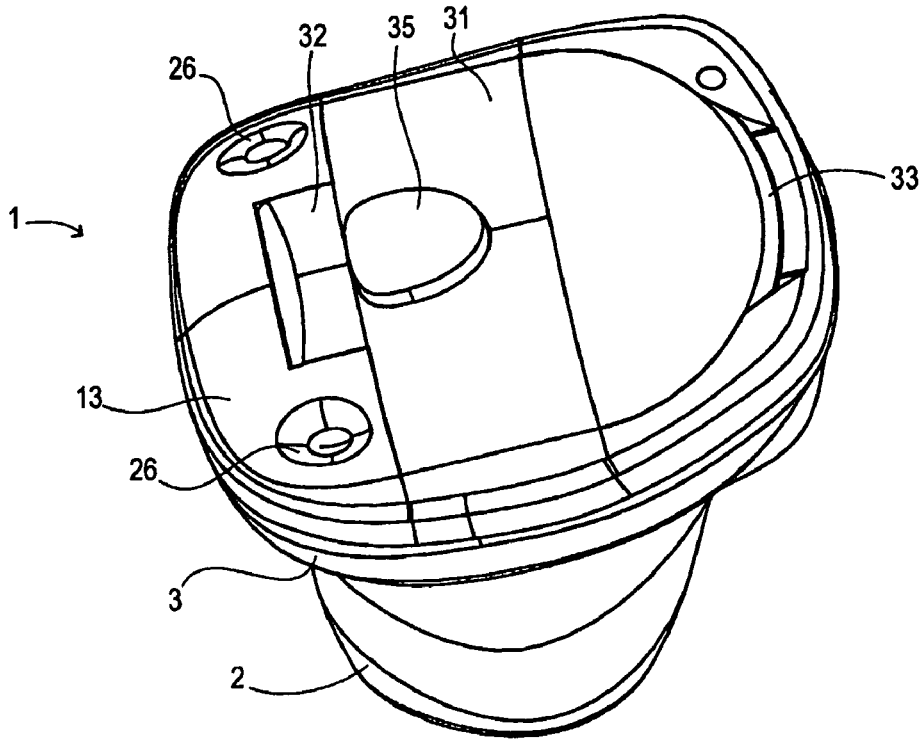
FIG. 1 shows a hearing aid.

Reference is first made to FIG. 1, which illustrates a hearing as seen from the top, i.e. from the side generally facing outwards from the wearer in the normal use position. FIG. 1 illustrates the hearing aid 1, generally comprising lid 31, faceplate 3, and shell 2. The lid comprises hinge portion 32, projection 25, and button 35. The figure further illustrates the outside of microphone adapter 13 according to a second embodiment, which features two sound inlets.

Figure 2:
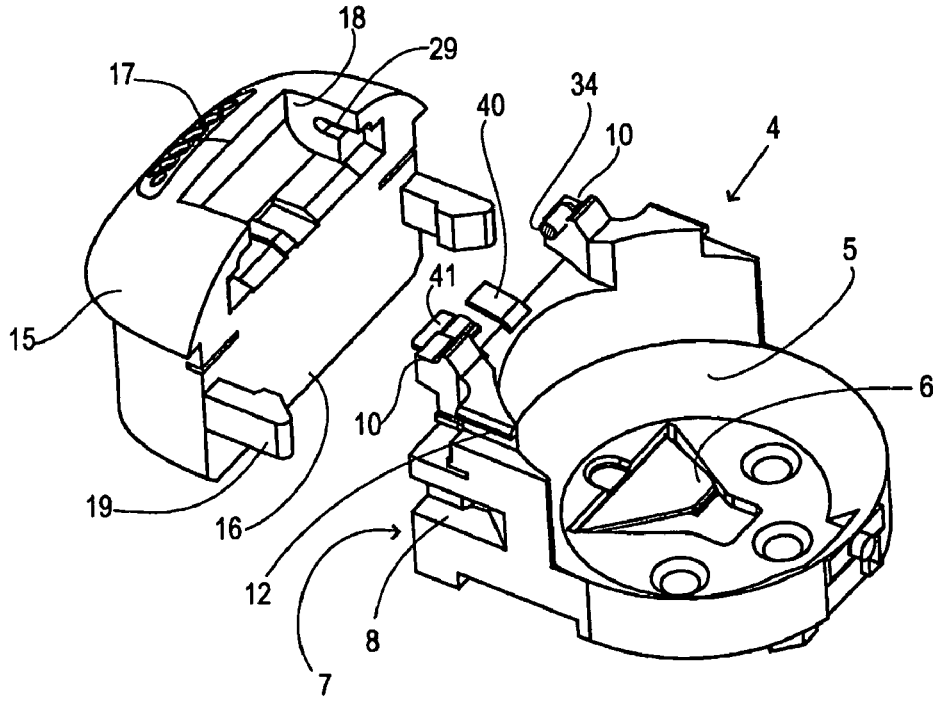
FIG. 2 shows a sub-assembly for a hearing aid in exploded view.
Figure 3:
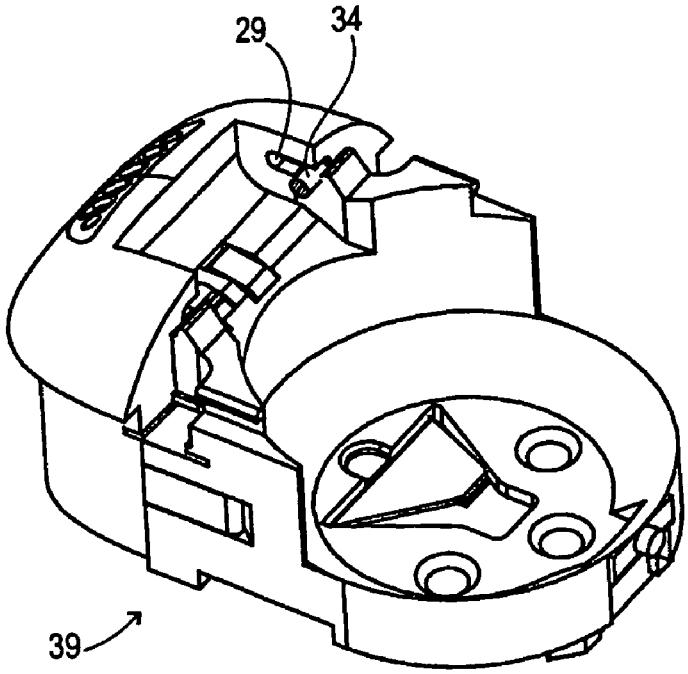
FIG. 3 shows the sub-assembly as assembled and with part of a pivot.
Figure 4:
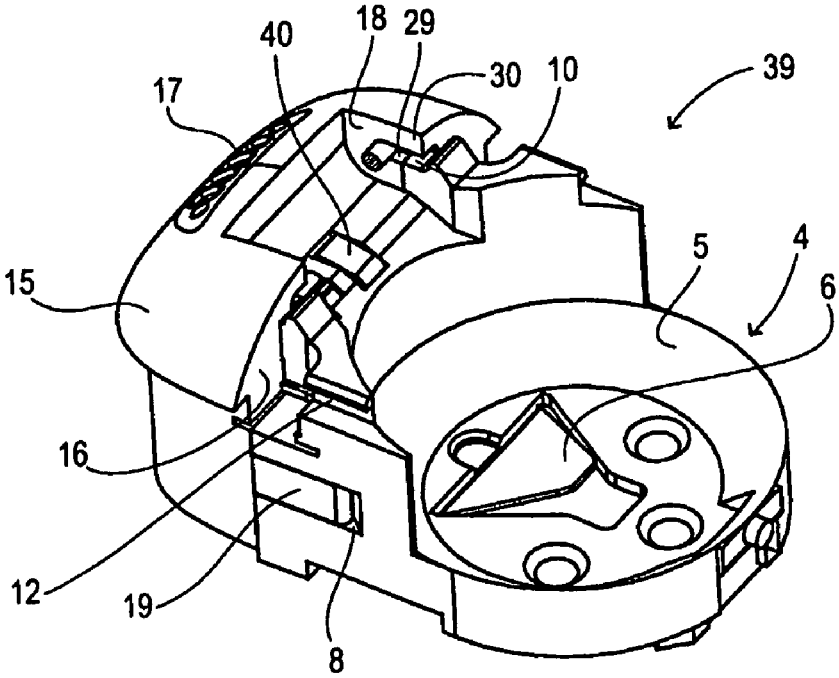
FIG. 4 is similar to FIG. 3, but illustrates the pivot in a different position.

Reference is made to FIGS. 2, 3 and 4 for an explanation of a sub-assembly for a hearing aid. The hearing aid sub-assembly comprises assembly 39, mainly consisting of electronics module 4 and microphone adapter 15 according to a first embodiment. The electronics module 4 comprises a solid body, which is adapted to fit inside the faceplate 3 and which provides battery compartment 5 with lower battery spring 6.

The electronics module 4 has lateral recesses that provide tracks 8, and projecting parts that provide laterally spaced pin guideways 10. FIGS. 2, 3 and 4 also illustrate part of the pin 34, which is a pivot of the lid 31.

Spaced above and generally parallel to the tracks 8 the electronics module 4 has dovetail guideways 12. The electronics module 4 is made of an electrically insulating material and provides supporting structure for various smaller parts as well as integrated electrical leads, as will be evident to those skilled in the art.

The microphone adapter 15 comprises a body for housing a microphone as will be explained further below. The FIGS. 2, 3 and 4 show grid 17, which communicates with the microphone sound ports, hinge recess 18 and lateral pin guideways 29. The microphone adapter 15 further comprises a flat front face 16 and projecting beams 19 with barbs. As will be understood from the FIGS. 2 and 3, the beams 19 and the tracks 8 are adapted for mating engagement to guide these components during assembly and to snap lock them together. The adapter 15 and the electronics module 4 together provide the assembly 39. In the assembled state, the module pin guideway 10 effectively extends the adapter pin guideway 29 to provide a groove 30 for shifting the pin forwards and backwards, FIGS. 2 and 3 depicting the pin 34 in the forward position while FIG. 4 depicts the pin in the rearmost position.

The groove 30 has a forward slot defined by the nip between the adapter and the module. The groove is adapted to normally allow the pin to shift back and forth between respective predetermined end positions, however, due to inherent resilience of the adapted and the module together with suitable design of the slot, the slot permits pulling the lid apart from the assembly by forcing the pins though the slot. Also, the lid can be mounted on the assembly by forcing the pivots into the groove through the slot.

FIGS. 2, 3 and 4 further show contact strips 40, 41, projecting from the electronics module and accessible for contacting from above. A first strip 40 is flat while a second strip 41, is crested. More contact strips may be arranged in juxtaposition, if necessary.

Figure 5:
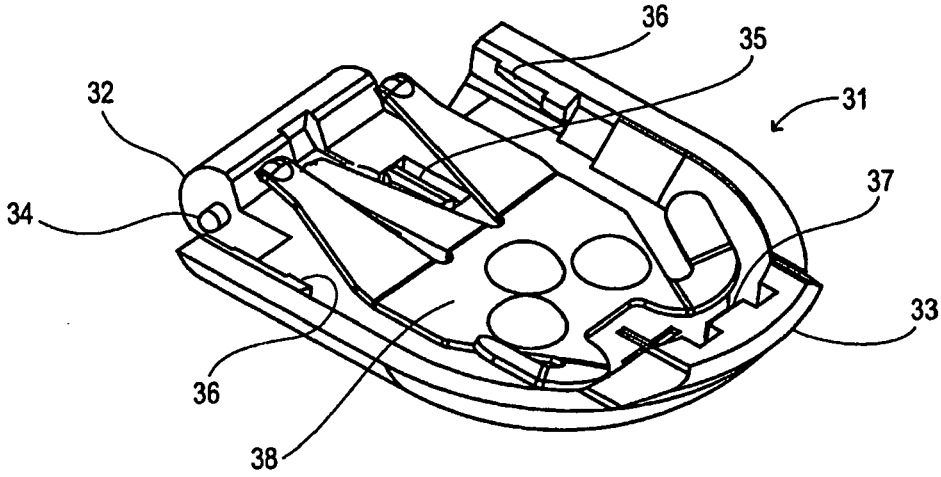
FIG. 5 shows a lid for a hearing aid in perspective as seen from below.

Reference is now made to FIG. 5, which shows the lid 31 as seen from the inside. FIG. 5 illustrates the lid 31, generally in the shape of a cap with projecting hinge portion 32, forward edge 33, rearward ratchet at the forward edge 33 and upper battery spring 38. Also part of part of the button 35 is visible. The upper battery spring 38 comprises a piece of flat, resilient, conductive material, e.g. brass, stamped and bent into a trident-like structure, with the base secured to the lid inside, the central prong bent downwards in FIG. 5 to contact the button, and the lateral prongs bent slightly upwards in FIG. 5. Opposite the prongs the spring extends into slanted, angled tabs adapted for contacting the battery.

As will be understood by those skilled in the art, when the battery is fitted and the lid closed, the battery spring angled tabs will serve to contact the battery, while the lateral prongs will contact a contact strip on the module adjacent the hinge thereby to establish an electrical connection between one pole of the battery and the strip of the electronics module. While the lid is closed, the lateral prongs bias the lid against the crested strip at a position intermediate the pins, so as to absorb any play in the hinge, and so as to arrest the motion of the lid. The central prong cooperates with the button 35, serving to bias the button upwards, and available to provide, on activation, contact to a respective contact strip of the module in connection with a programming input of the electronics.

At the hinge portion 32, the lid is provided with a transverse pin 34 with projecting ends adapted to provide pivot pins. Along the sides, the lid has inward oblique ribs or cams 36.

Figure 6:
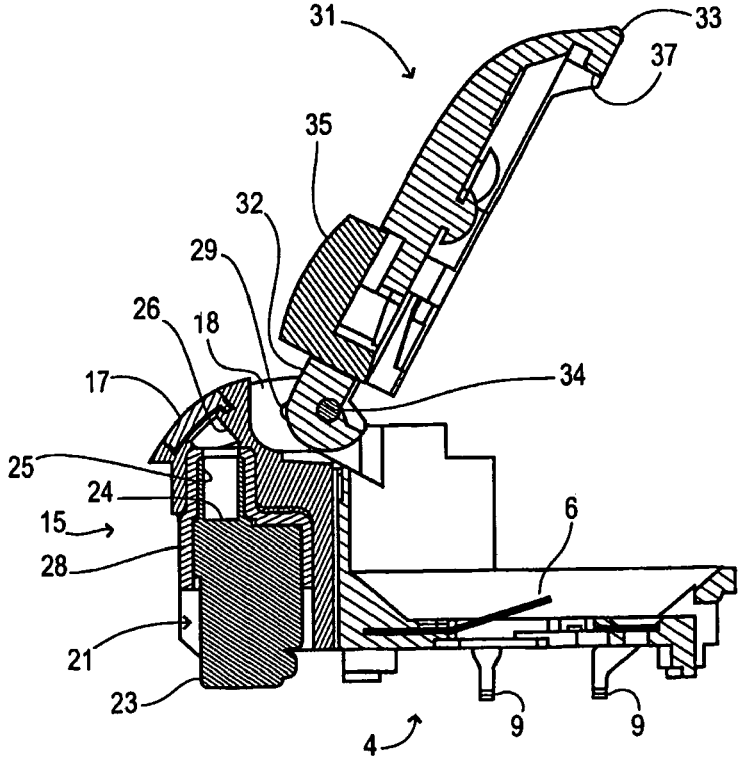
FIG. 6 shows a vertical section of the sub-assembly together with a lid, as in an open position.

Reference is made to FIG. 6, which illustrates a section through the assembly with lid 31, as in the open position. The section illustrates the button 35 and the pin 34, which has been shifted to the foremost position. At the bottom, the electronics module 4 comprises lugs 9 for attachment of an electronic circuit board. FIG. 6 further illustrates microphone, microphone port, sound conduit 26, and gasket 28. The adapter face lies against the module rear face 7 sandwiching between them a thin, resilient pad 11.

Figure 7:
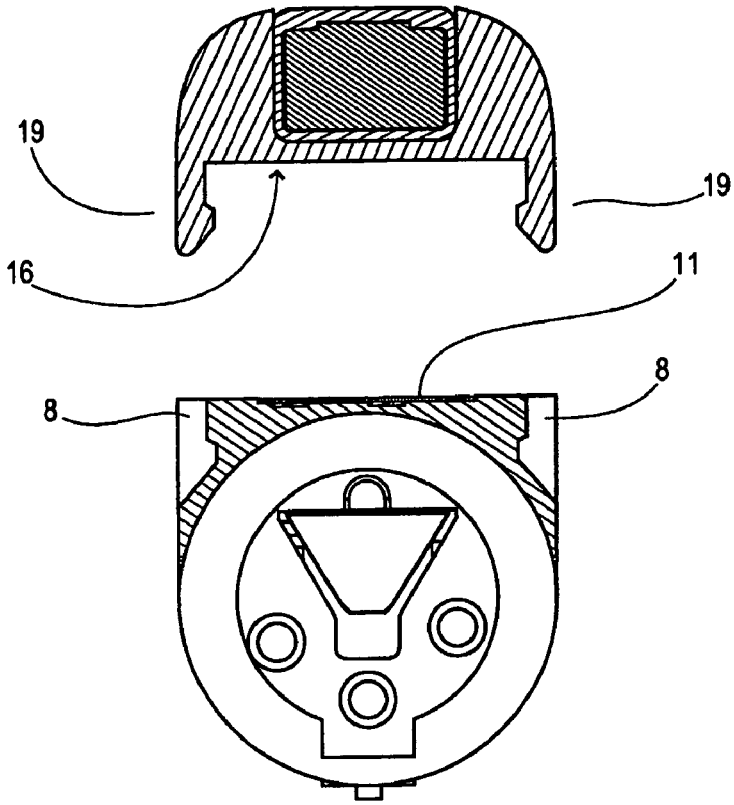
FIG. 7 shows a horizontal section through the subassembly in with the components pulled apart.
Figure 8:
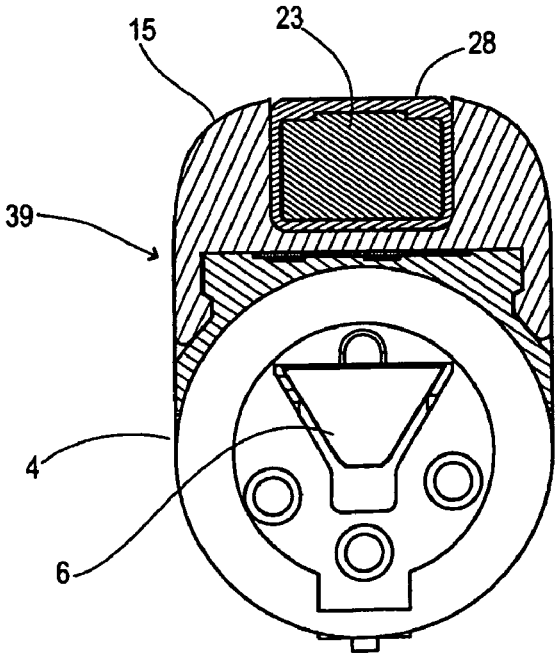
FIG. 8 is similar to FIG. 7 but shows the components assembled.

Reference is now made to FIGS. 7 and 8, which illustrate a horizontal section through the assembly, in exploded and in assembled state, respectively. FIGS. 7 and 8 illustrate in particular the engagement between the beams 19 and the tracks 8, and the sandwiched arrangement of the resilient pad 11. The pad 11 provides mechanical biasing in the engagement, and it may in embodiments with exposed leads serve the purpose of providing electric insulation. FIGS. 7 and 8, similarly to FIGS. 2, 3 and 4, illustrate a first embodiment of the adapter 15, accommodating a single microphone 23.

Figure 9:
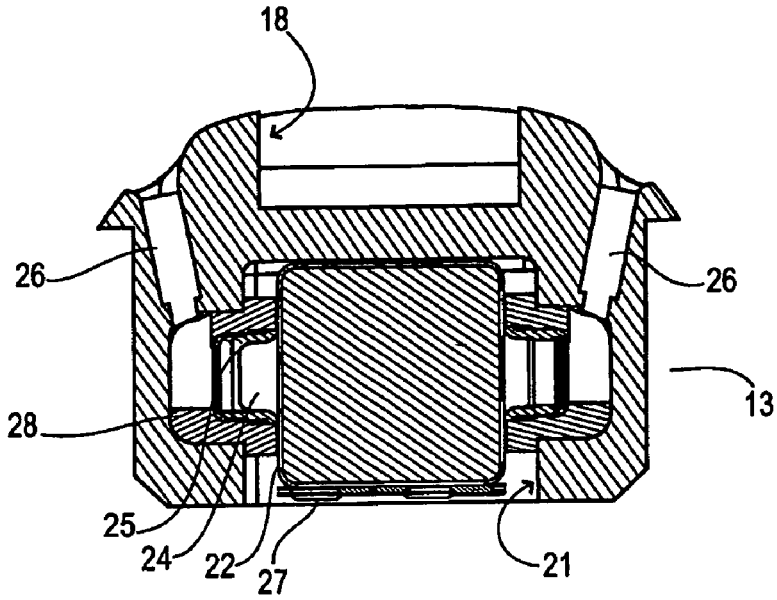
FIG. 9 shows a vertical section of a microphone adapter according to a first embodiment.

Reference is now made to FIG. 9 for a vertical section through an adapter 13 according to the second embodiment, accommodating a directional microphone 22. The section in FIG. 9 is taken in the axes of the adapter sound conduits 26, which slant upwards in FIG. 9. The directional microphone has ports 24 defined by laterally opposing stubs 25. The stubs 25 have been covered by sleeve-like gaskets 28, upwards recessed to open for communication with the sound conduits 26. As may be understood from the figure, the microphone adapter 13 provides a compartment 21 suitable for accommodating the microphone with the gaskets 28, the gaskets providing sealing connection as well as resilient suspension of the microphone. FIG. 9 also illustrates the hinge recess 18, the sides of which serve to guide the lid 31 during shifting and pivoting. The microphone has solder pads 27 accessible at the lower side.

Figure 10:
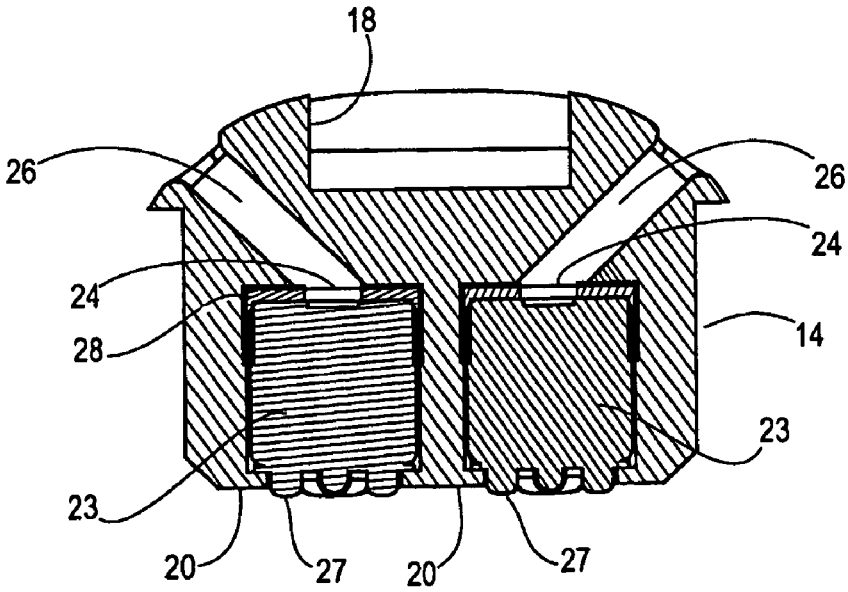
FIG. 10 shows a vertical section of a microphone adapter according to a second embodiment.

Reference is now made to FIG. 10 for an illustration of a microphone adapter 14 according to a third embodiment, accommodating a pair of microphones. These microphones will generally be identical, omidirectional microphones 23 that pick up the sound field at spaced positions in order that sound field gradients can be provided to the electronics circuit. These microphones are smaller, and they have the ports arranged at the topside, as illustrated in FIG. 10. The microphone compartments 21 are adapted to these microphones, and the feature lower ledges 20. The gaskets 28 enclose the upper parts of the microphones, and the sound conduits 26 are adapted to the microphone ports, as will be evident to those skilled in the art. The microphone solder pads 27 are accessible at the bottom.

Figure 11:
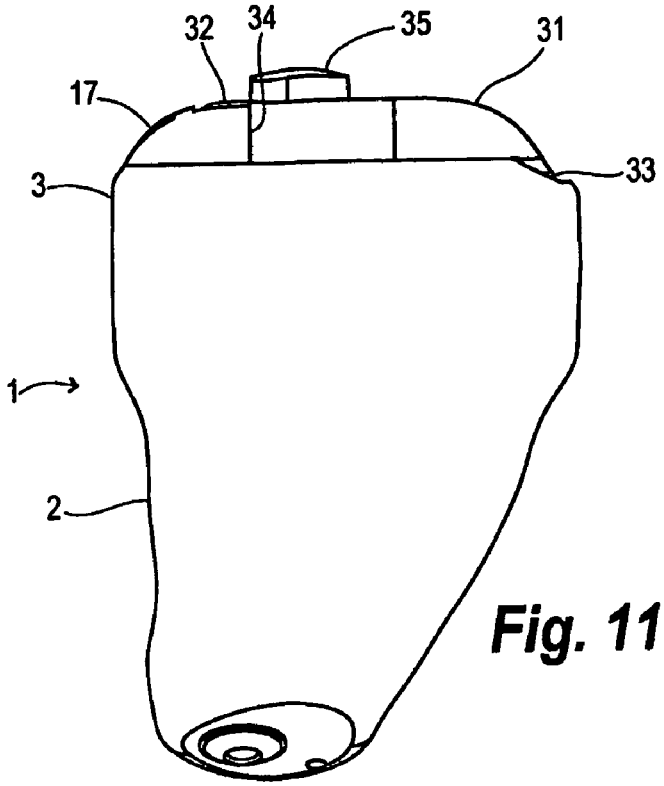
FIG. 11 shows a side view of a hearing aid ready for use.
Figure 12:
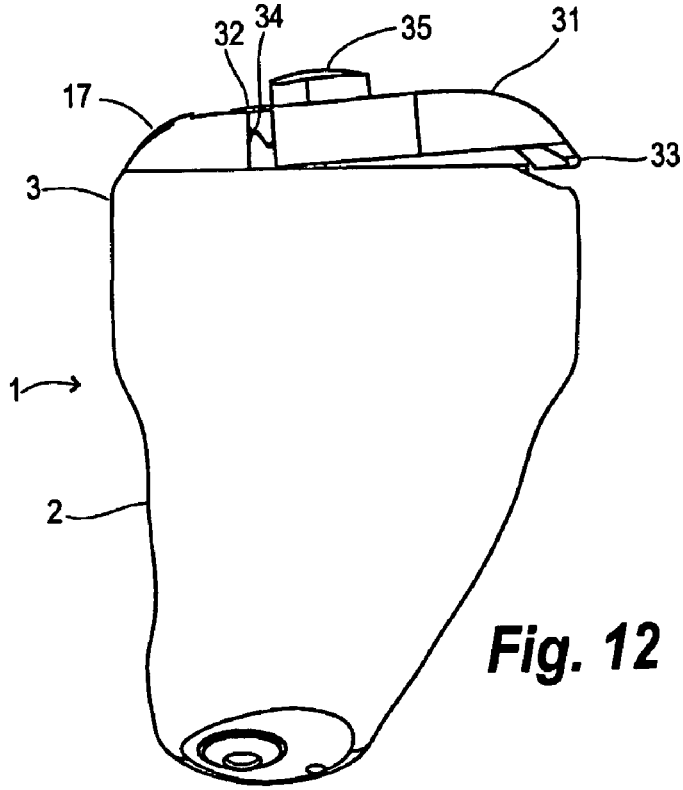
FIG. 12 is similar to FIG. 11 but shows the lid partially opened.

Reference is now made to FIGS. 11 and 12 for an illustration of the initial stages of opening of the lid 31. FIG. 11 shows the hearing aid 1 with adapter 13 of the second embodiment in the position ready for use. In order to open the lid, the operator pushes the lid forwards, away from the grid 17. The pin 34 slides forwards in the groove 30, i.e. from the position of FIG. 4 to the position of FIG. 3, while the cams 36 of the lid slide forward in the dovetail guideways 12 (ref. also to FIG. 5). In the foremost position, the pins rest against the foremost ends of the grooves, the cams 36 clear the dovetail guideways 12, and the lid 31 lifts slightly upwards under the resilient pressure of the upper battery spring 38. The lid ratchet 37 leaves its engagement with a cooperating structure of the module (not shown), and forward edge 33 is readily available for manipulation by the operator to turn the lid all the way to the position shown in FIG. 6.

Closing the lid takes place through an opposite succession of steps. Initially, the lid is turned downwards, then pushed back towards the adapter. On sliding backwards, the lid cams engage the dowetail guideways, the angle of the cams helping to guide the parts together and, on driving the lift fully backwards, to press the lid hinge portion downwards into a solid engagement with the module. On sliding back, the lid ratchet 37 enters a catch of the module (not shown), and one of the lateral springs 41 ride over the crest of the crested strip to snap lock the engagement.

Following the description of the design of these components, a brief description of the assembly of the components shall be given. The microphone is fitted with a suitable sleeve and inserted into the battery compartment 5 of the adapter. The adapter is assembled with the electronics module 4 with the beams 19 in snap locking engagement with suitable hollows in the tracks 8. The combined unit is turned upside down, and the electronic circuit board put in place. Flexible leads are soldered to the microphone solder pads 27. The circuit board is soldered to the lugs 9, and the leads are connected to the circuit board. The lid may be snapped in place later on, as the nip between the adapter front face 16 and the module rear face 7 may yield resiliently to let the pins slip into the grooves. The combined unit is fixed in a faceplate 3. The shell 2 is made, normally customized to the user, and joined with the faceplate 3.

Modification to accommodate a different type of microphone requires providing a dedicated version of the adapter. Tailoring a dedicated adapter requires providing a body suitably shaped to interface with the electronics module and especially tailored to accommodate the desired microphone. Other modifications and variations of the structures and procedures will be evident to those skilled in the art.

I claim:

1. A component for a hearing aid comprising an electronics module, and a microphone adapter, wherein each of the electronics module and the microphone adapter provides a pin guideway to form a groove for sliding engagement of a pivot of a lid in an assembled state, the groove extending over part of the electronics module and over part of the adapter, between a position where the lid is closed and a position where the lid is partially open.

2. The component according to claim 1, wherein the microphone adapter provides a fixture for securing a microphone and a sound conduit for conveying sound from the surroundings to a port of the microphone.

3. The component according to claim 1, comprising means for securing the lid in closed position.

4. The component according to claim 1, comprising sliding guides for guiding a sliding motion of the lid, substantially without swinging.

5. The component according to claim 1, comprising a pair of laterally spaced grooves for sliding engagement with laterally projecting pivots of the lid.

6. The component according to claim 5, comprising contact strips intermediate the grooves for contacting springs of the lid.

7. The component according to claim 1, wherein the electronics module and the microphone adapter comprise snap lock engagement means.

8. The component according to claim 1, comprising resilient means for securing the lid in the closed position.

9. A hearing aid comprising a lid, an electronics module, and a microphone adapter, wherein each of the electronics module and the microphone adapter provides a pin guideway to form a groove for sliding engagement of the pivot of a lid in an assembled state, the groove extending over part of the electronics module and over part of the adapter, between a position where the lid is closed and a position where the lid is partially open.

* * * * *